US006964070B2

(12) United States Patent
Hawk et al.

(10) Patent No.: US 6,964,070 B2
(45) Date of Patent: Nov. 15, 2005

(54) PATIENT LIFTING APPARATUS

(75) Inventors: Gary Lee Hawk, 677 S. Stage Rd., Medford, OR (US) 97501; Linda L. Hawk, 677 S. Stage Rd., Medford, OR (US) 97501; Caleob King, Lawrence, KS (US)

(73) Assignees: Gary Lee Hawk, Medford, OR (US); Linda L. Hawk, Medford, OR (US)

( * ) Notice: Subject to any disclaimer, the term of this patent is extended or adjusted under 35 U.S.C. 154(b) by 0 days.

(21) Appl. No.: 10/706,688

(22) Filed: Nov. 12, 2003

(65) Prior Publication Data

US 2005/0097670 A1 May 12, 2005

(51) Int. Cl.[7] ..... A61G 7/08

(52) U.S. Cl. ..... 5/81.1 R; 5/83.1; 5/84.1; 5/87.1

(58) Field of Search ..... 5/661, 81.1 R, 5/83.1, 84.1, 85.1, 87.1, 662; 254/2 C, 4 C; 4/560.1, 561.1, 562.1, 560.2, 560.3

(56) References Cited

U.S. PATENT DOCUMENTS

| | | | | | |
|---|---|---|---|---|---|
| 1,269,734 | A | * | 6/1918 | Noland | 5/84.1 |
| 2,821,406 | A | * | 1/1958 | Hoyer et al. | 280/657 |
| 2,981,959 | A | * | 5/1961 | Burnham | 5/503.1 |
| 3,104,399 | A | * | 9/1963 | Dalton | 4/562.1 |
| 4,144,713 | A | | 3/1979 | Clark et al. | |
| 4,554,691 | A | | 11/1985 | Daugherty | |
| 4,571,758 | A | * | 2/1986 | Samuelsson | 5/83.1 |
| 5,459,891 | A | | 10/1995 | Reeve et al. | |
| 5,560,054 | A | | 10/1996 | Simon | |
| 5,651,149 | A | * | 7/1997 | Garman | 5/81.1 R |
| 5,845,348 | A | | 12/1998 | Dunn et al. | |
| 5,987,664 | A | | 11/1999 | Somerton et al. | |
| 6,026,523 | A | | 2/2000 | Simon et al. | |
| 6,047,418 | A | * | 4/2000 | Seide et al. | 5/83.1 |
| 6,289,534 | B1 | | 9/2001 | Hakamiun et al. | |
| 6,665,894 | B2 | * | 12/2003 | Moffa et al. | 5/86.1 |
| 6,742,201 | B2 | * | 6/2004 | Porcheron | 5/86.1 |

* cited by examiner

*Primary Examiner*—Heather Shackelford
*Assistant Examiner*—Fredrick Conley
(74) *Attorney, Agent, or Firm*—Dale J. Ream

(57) ABSTRACT

A patient lifting apparatus is provided that attaches to a bed frame having a plurality of legs and a headboard. The apparatus includes an upright member, a boom mechanically associated with the upright member, an upper support bar that extends across the bed frame and secures the upright member to each side of the headboard, and a lower support bar that extends across the bed frame and secures the upright member to the legs. The upright member is supported for rotation about a vertical axis by upper and lower bearings on the upper and lower support bars, respectively. A telescoping foot member extends from the lower support bar and is movable between a stored position and an extended position for stabilizing the lifting apparatus. A support arm extends from a lower end of the upright member and rotates along with the upright member to transfer vertical forces into the floor.

7 Claims, 8 Drawing Sheets

PATIENT LIFTING APPARATUS

BACKGROUND OF THE INVENTION

1. Field of the Invention

The present invention relates generally to patient lifting equipment. In particular, the present invention relates to a patient lifting apparatus for lifting and transferring incapacitated persons to and from a bed.

2. Description of the Related Art

Persons confined to a bed due to illness, age, obesity and so forth often have such limited mobility that movement or transfer from their bed is extremely difficult. It is well known to provide such persons with a patient lift to hoist the person from the bed and move him or her into a wheel chair or other desired location. Most such prior art patient lifts permit the patient to be raised or lowered and also permit the patient to be swiveled away from the bed about a vertical support member.

For example, in U.S. Pat. Nos. 4,554,691 and 5,459,891, patient lifting devices are disclosed in which a vertical support member is attached to support brackets which are secured to a floor and to a ceiling. A boom extends from the vertical support member and can be raised and lowered to lift the patient. However, the support brackets make these devices difficult to install in many locations where a permanent installation is undesirable (e.g., a temporary home care situation).

In U.S. Pat. Nos. 4,144,713, 5,560,054, 5,845,348, 5,987,664, 6,026,523 and 6,289,534, patient lift devices are disclosed which include wheeled support structures that allow the devices to be wheeled from place-to-place in a health care facility and used as stand alone equipment (i.e., they are not attached to the floor, ceiling or other fixture in the room). However, these devices typically require relatively heavy materials to provide the structural strength necessary to handle the bending moments and vertical forces encountered during use. As a result, these devices are expensive to manufacture and quite heavy, making them unsuitable for many health care facilities and home care situations.

Thus, there is a need for an improved patient lifting apparatus that is lightweight and capable of being temporarily attached to a fixture within the patient's room to lift and transport the patient to and from the patient's bed.

SUMMARY OF THE INVENTION

An object of the present invention to provide an improved patient lifting apparatus that overcomes the problems and disadvantages of the conventional patient lifts described above.

More specifically, it is an object of the present invention to provide a patient lifting apparatus that attaches to a patient's bed frame and uses the bed frame as a structural component for lifting and moving the patient, thereby reducing the weight and cost of the apparatus without sacrificing strength and durability.

It is a further object of the present invention to provide a patient lifting apparatus having an attachment system that is adjustable to accommodate different sizes and styles of bed frames.

It is a further object of the present invention to provide a patient lifting apparatus that is relatively simple mechanically while at the same time being reliable and safe in operation.

It is a further object of the present invention to provide a patient lifting apparatus that may be conveniently operated by a patient through the use of mechanical actuators and a hand held control to selectively raise, lower and/or translate the patient from one location to another.

In order to accomplish these and other objects of the invention, a patient lifting apparatus is provided that attaches to a bed frame having a plurality of legs and a headboard. The apparatus includes an upright member formed of a central inner column and an outer pipe that fits over the inner column. A boom is mechanically associated with the upright member and has a structure supported at its free end for attaching to or being gripped by the patient. The upright member is attached to the bed frame by upper and lower support bars. The upper support bar extends across the bed frame and secures the upright member to each side of the headboard of the bed frame. The lower support bar extends across the bed frame and secures the upright member to the legs of the bed frame. The upright member is supported for rotation about a vertical axis by upper and lower bearings on the upper and lower support bars, respectively. A telescoping foot member extends from the lower support bar and is movable between a stored position and an extended position for stabilizing the lifting apparatus. A support arm extends from a lower end of the upright member and rotates along with the upright member to transfer vertical forces from the lifted weight into the floor.

According to a broad aspect of the present invention, a patient lifting apparatus is provided, comprising: an upright member; a boom mechanically associated with the upright member for conveying a patient from one location to another; and a support structure for attaching the upright member to a bed frame. The support structure is arranged to transfer torque from the lifting apparatus to the bed frame during operation.

According to another broad aspect of the present invention, a patient lifting apparatus is provided, comprising: an upright member having upper and lower ends, the upright member being pivotal about a vertical axis; a boom means mechanically associated with the upright member for lifting and conveying a patient from one location to another; and a support means for attaching the upright member to a bed frame, the support means being arranged to transfer torque from the upright member into the bed frame during operation.

Numerous other objects of the present invention will be apparent to those skilled in this art from the following description wherein there is shown and described preferred embodiments of the present invention, simply by way of illustration of some of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A patient lifting apparatus according to preferred embodiments of the present invention will now be described in detail with reference to FIGS. 1 to 8*b* of the drawings.

Figure 1:
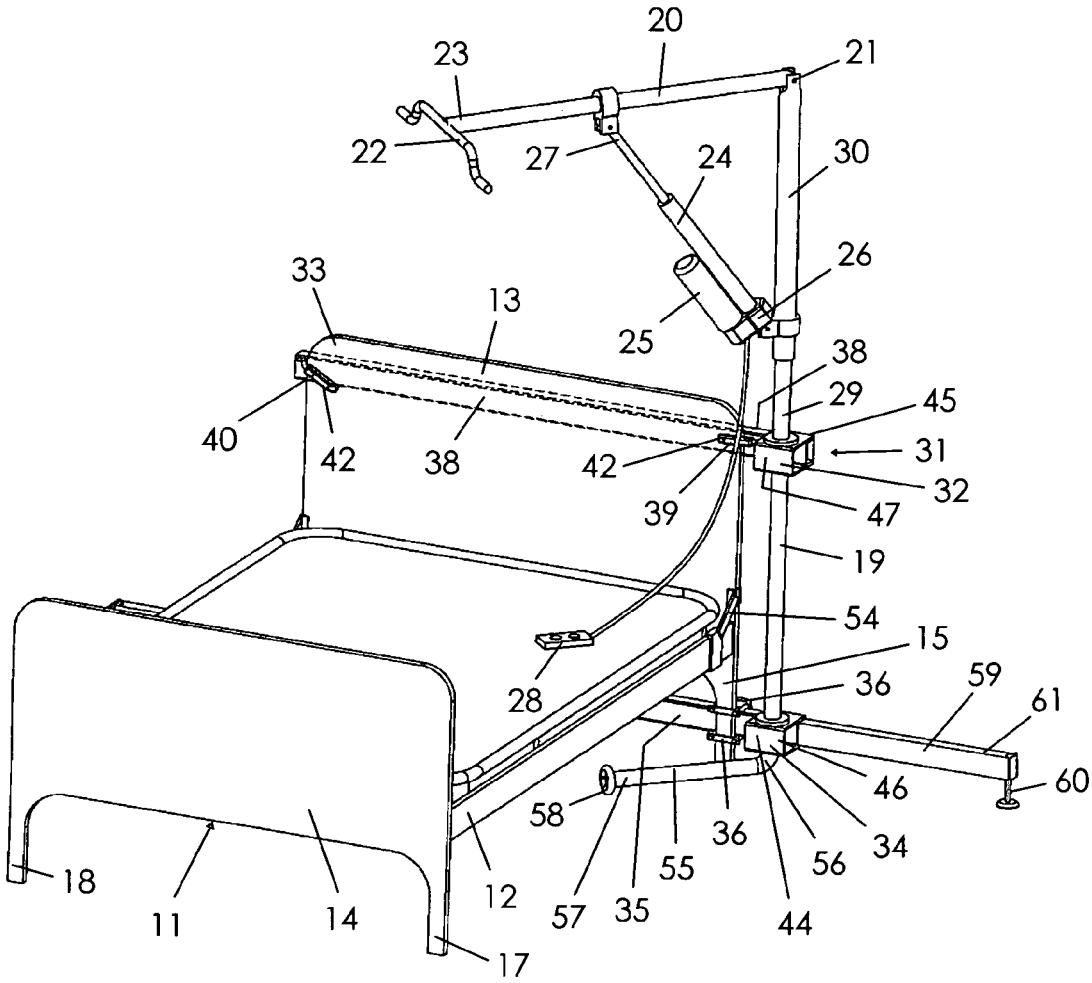
FIG. 1 is a perspective view of a patient lifting apparatus according to the present invention attached to a bed frame.
Figure 2:
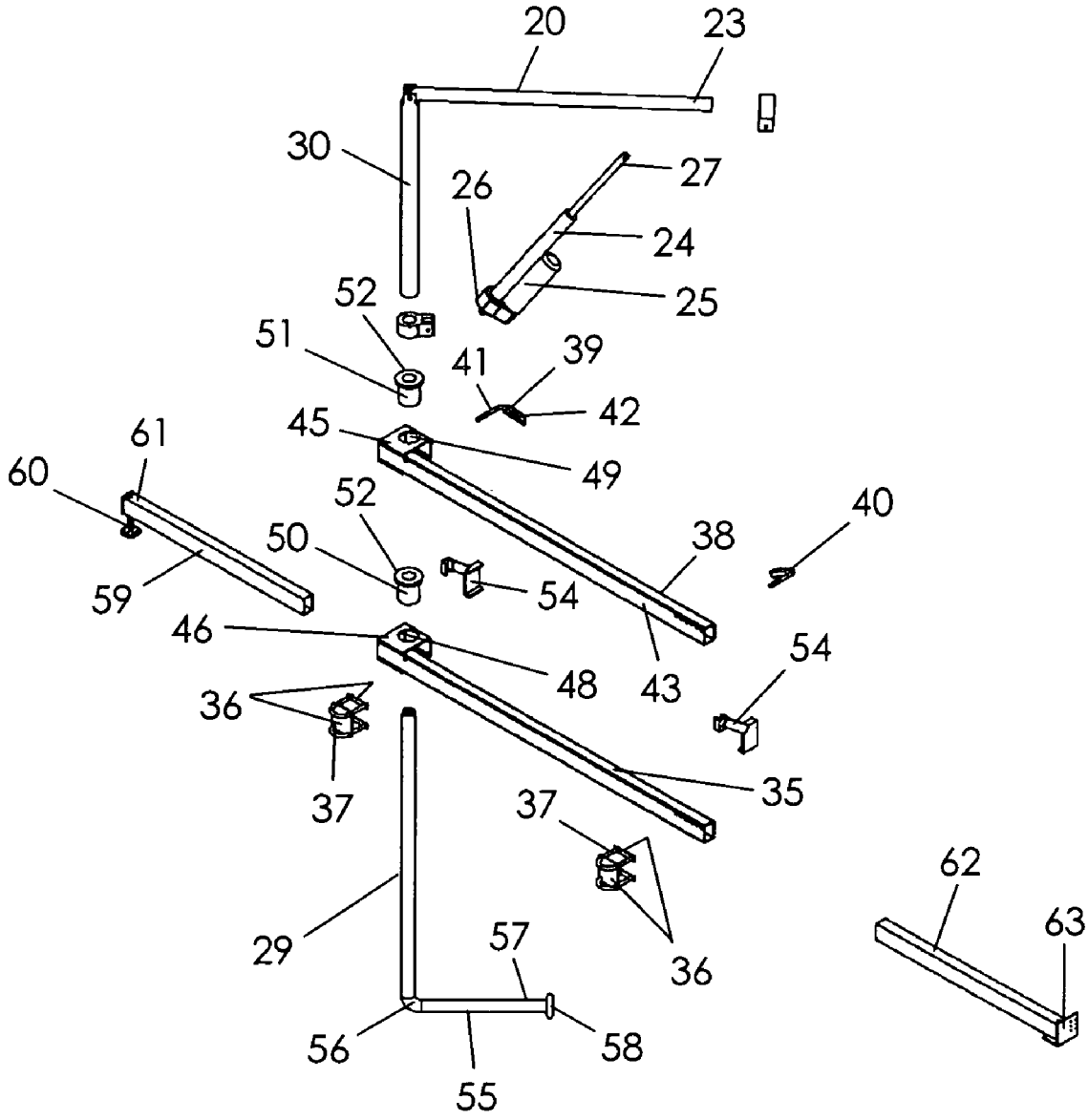
FIG. 2 is an exploded perspective view of the individual components of the patient lifting apparatus shown in FIG. 1.

The patient lifting apparatus 10 according to a first embodiment is shown in FIG. 1 in combination with a bed frame 11, and is shown in FIG. 2 as an exploded view of the various individual components. The bed frame 11 is a conventional design including left and right side rails 12, a headboard 13, and a footboard 14. A first pair of legs 15, 16 are formed at the bottom of the headboard 13, and a second pair of legs 17, 18 are formed at the bottom of the footboard 14. A plurality of cross members (not shown) normally extend between the side rails 12 to support a box spring and mattress assembly (not shown) in the case of most beds found in private homes, or a platform and folding mechanism (not shown) in the case of adjustable hospital beds.

Although little standardization exists in bed frames, standard mattress sizes tend to drive the typical designs of the bed frames. The most common mattress sizes are Twin (39" W×75" L), Full (54" W×75" L), Queen (60" W×80" L), and King (78" W×80" L). The patient lifting apparatus 10 of the present invention is adjustable to accommodate these common sizes and also a large range of other sizes and constructions of bed frames 11.

The patient lifting apparatus 10 includes an upright member 19 and a boom 20 mechanically associated with the upright member 19. The boom 20 is pivotally attached to the upper end of the upright member 19 for pivoting movement about a generally horizontal axis 21. A grapple, sling or other suitable structure 22 is secured to the free end 23 of the boom 20 for engaging a patient to be lifted.

Figure 3A:
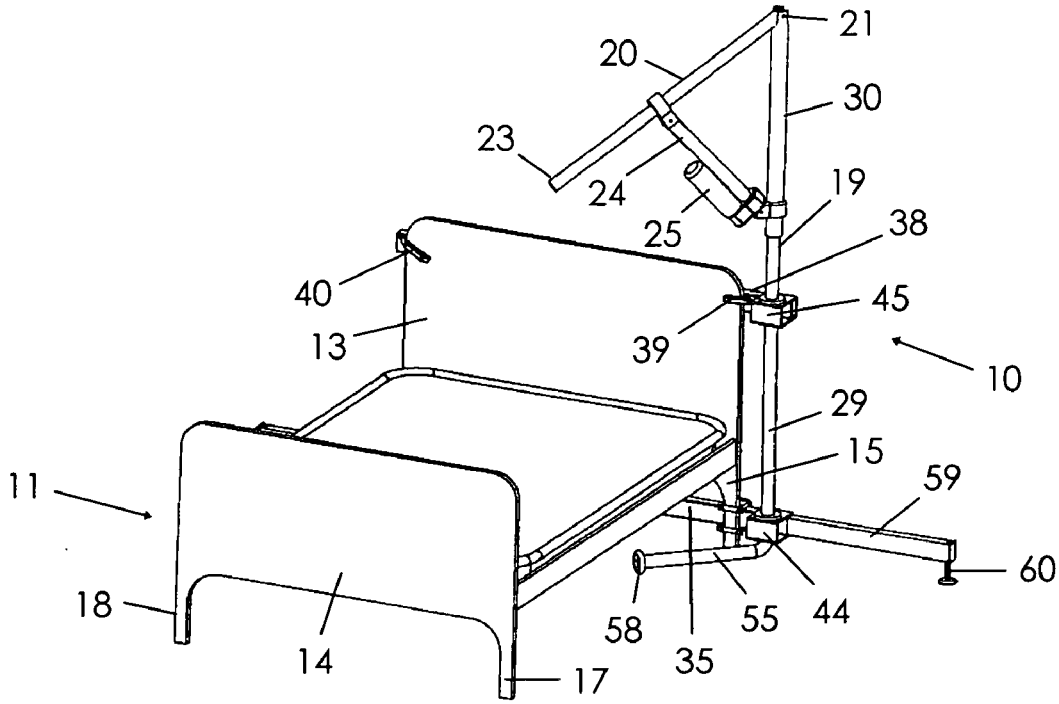
FIGS. 3*a* and 3*b* are perspective views illustrating the pivoting movement of the boom of the patient lifting apparatus from a first lowered position shown in FIG. 3*a* to a second raised position shown in FIG. 3*b*.
Figure 3B:
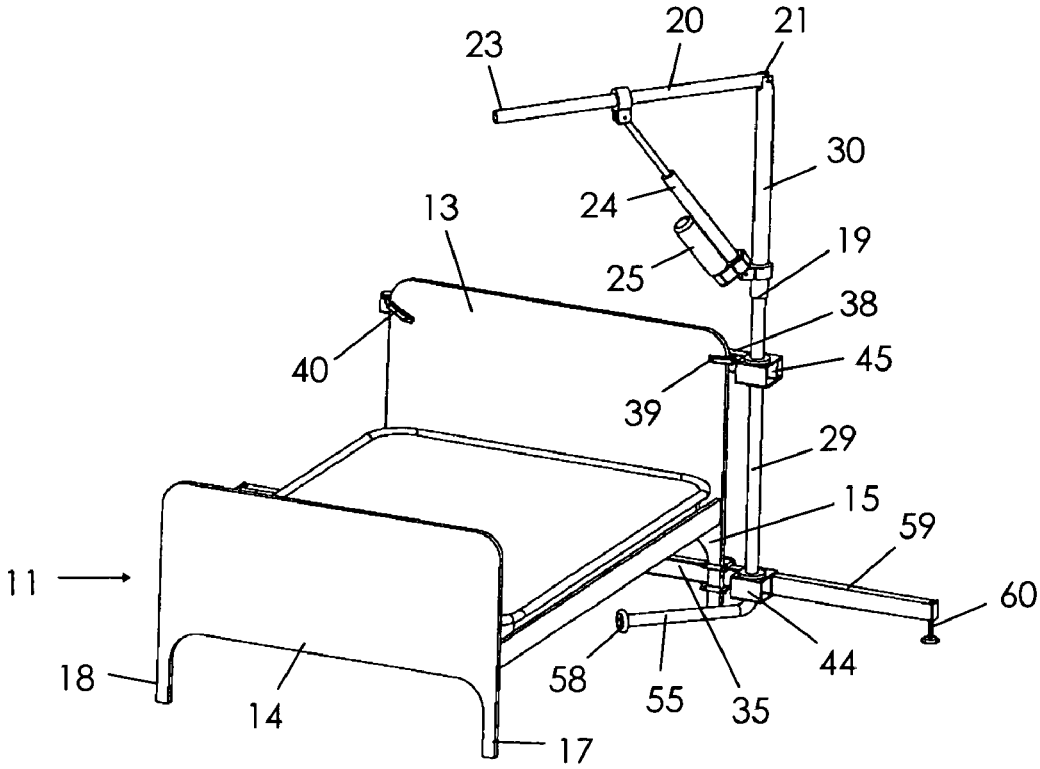

A mechanical means is provided to selectively raise and lower the structure 22 at the end 23 of the boom 20 for lifting and conveying a patient from one location to another. The mechanical means can be a linear actuator 24 driven by an electric motor 25, as shown in FIGS. 1 to 7*a*. However, other types of linear actuators, such as an actuator driven by hydraulic pressure, can also be used. Alternatively, the mechanical means can be a winch assembly (as described below) or a rack and pinion or other suitable mechanical assembly that accomplishes the objective of raising and lowering the structure 22 at the end 23 of the boom 20. In the illustrated embodiment, the linear actuator 24 is operable to move the boom 20 between a lowered position, as shown in FIG. 3*a*, and a raised position, as shown in FIG. 3*b*.

The linear actuator 24 in FIG. 1 has a first end 26 pivotally connected to the upright member 19, and a second end 27 pivotally connected to the boom 20. The linear actuator 24 is thus arranged to selectively raise and lower the free end 23 of the boom 20 upon extension and retraction of the actuator 24. The electric motor 25 of the actuator 24 is connected to an electrical power source (not shown). A hand held control 28 is connected to the electric motor 25, which can be operated easily by the patient or an assistant to energize the motor 25 and raise or lower the boom 20 as desired.

In the preferred embodiment, the upright member 19 comprises a central inner column 29 made of pipe and an outer pipe 30 that slips over an upper portion of the central column 29. The use of pipe for the upright member 19 will allow the assembly to swivel freely, and will maximize the strength-to-weight ratio of the main components 29, 30 supporting the patient's weight. For example, Schedule 80 steel pipe can be used, with the outer pipe 30 being provided in a 2-inch diameter nominal size and the inner pipe 29 being provided in a 1 2-inch diameter nominal size to nest within the outer pipe 30.

The linear actuator 24 and the boom 20 are both attached to the outer pipe 30. As such, the linear actuator 24 and boom 20 can be easily removed to facilitate mobility from one bed to another. For example, several inexpensive base assemblies (i.e., the central column 29 and other parts attached to the bed frame 11) could be attached to the appropriate beds in a health care facility, and the comparatively more expensive actuator 24 and boom 20 assembly moved from bed-to-bed as needed.

A support structure 31 is provided for attaching the patient lifting apparatus 10 to the bed frame 11. The support structure 31 includes an upper attachment system 32 that secures the upright member 19 to an upper portion 33 of the headboard 13, and a lower attachment system 34 that secures the upright member 19 to at least one, and preferably two, of the legs 15, 16 of the bed frame 11. The support structure 31 is arranged to transfer torque from the lifting apparatus 10 to the bed frame 11 during operation.

The lower attachment system 34 of the support structure 31 comprises a lower support bar 35 that extends across the bed frame 11 and has each of its ends fastened to a respective leg 15, 16 of the bed frame 11. The particular fastening means in the preferred embodiment comprises a predrilled clamping plate 36 and a pair of U-bolts 37 at spaced locations along the lower support bar 35. The U-bolts 37 allow the lower support bar 35 to be attached to bed legs 15, 16 with both square and round cross sections, as well as other less common shapes. Various other types of threaded fasteners, such as hex head bolts, can also be used in conjunction with the clamping plates 36, instead of the U-bolts 37, to clamp the lower support bar 35 to the legs 15, 16 of the bed frame 11.

The U-bolts 37 and predrilled clamping plates 36 can be slid along the length of the lower support bar 35 to accommodate different sizes of bed frames 11. Alternatively, the lower support bar 35 can be made as a telescoping assembly of two members that allow an adjustment in length to accommodate different widths of bed frames 11.

The upper attachment system 32 of the support structure 31 comprises an upper support bar 38 that extends across the bed frame 11 and has each of its ends fastened to a respective side of the headboard 13 of the bed frame 11. Since the headboard 13 is often the most expensive part of the bed, it is important to avoid marring the headboard 13 with the upper support bar 38. Thus, it is desired that the upper portion 33 of the headboard 13 carry as little load as possible. A pair of L-shaped clamps 39, 40 are positioned at each side of the headboard 13. The clamps 39, 40 each have a threaded portion 41 for receiving a nut (not shown) that can be tightened to apply and maintain a clamping force on the headboard 13. A soft molded plastic jaw member 42 is used with each of the clamps 39, 40 to avoid marring the headboard 13.

A plurality of mounting holes 43 are spaced along the upper support bar 38 for accommodating different sizes of bed frames 11. Alternatively, the upper support bar 38 can be made as a telescoping assembly of two members that allow an adjustment to accommodate different widths of bed frames 11. The lower and upper support bars 35, 38 can be made identical to each other, with the exception of the respective clamping structures, to reduce manufacturing costs.

The lower and upper support bars 35, 38 each have a bearing structure 44, 45 secured to one end thereof for supporting the upright member 19. The bearing structures 44, 45 are mounted to the support bars 35, 38 by respective bent plate weldments 46, 47 with vertical bores 48, 49 extending therethrough. A lower bearing 50 is received in the vertical bores 48 of the weldment 46 on the lower support bar 35, and an upper bearing 51 is received in the vertical bores 49 of the weldment 47 on the upper support bar 38. The lower and upper bearings 50, 51 allow smooth rotation of the upright member 19 relative to the support bars 35, 38, while transferring radial forces and the torque generated by such radial forces through the bearings 50, 51 and into the bed frame 11 during use.

In the preferred embodiment, plastic coated bushings (e.g., Teflon7 or similar) are used as the upper and lower bearings 50, 51. The bushings 50, 51 each have a collar 52 at one end that rests on the respective upper surface of the weldment 46, 47 of the lower or upper support bars 35, 38 to maintain the bushings 50, 51 in place. The bushings 50, 51 are arranged to absorb radial forces from the upright member 19 when a vertical force is applied at the end 23 of the boom 20. Instead of bushings, the lower and upper bearings 50, 51 could also be radial ball bearings or other suitable bearing structures. A collar (not shown) can be fixed to the upright member 19 just above the lower bearing 50 to transmit axial (i.e., thrust) forces from the vertical force of a patient's weight through the lower support bar 35 into the legs 15, 16 of the bed frame 11.

Typical bed frames 11 are designed to handle significant weights. However, a moment or twisting force imparted to a bed frame 11 is something the frame is likely to encounter only incidentally as it is moved, or momentarily as a person moves on top of the bed. Thus, the joint that joins the side rails 12 to the headboard 13 cannot be relied upon to resist the more than 1,500 ft-lbs of torque created by suspending a large weight from the end 23 of the boom 20.

One solution to this problem is to reinforce the bed frame 11. This can be accomplished by installing a pair of braces 54 between the headboard 13 and the side rails 12, as shown in FIG. 1, to help stabilize the bed frame 11 when used with the patient lifting apparatus 10 of the present invention. While simple and effective, this solution is difficult to generalize to all bed frames because some side rails are angle iron, some rails are wooden, and some rails form a "box" to contain a spring and mattress set. The large variety of construction techniques for bed frames makes offering kits to encompass all of them difficult.

Figure 4A:
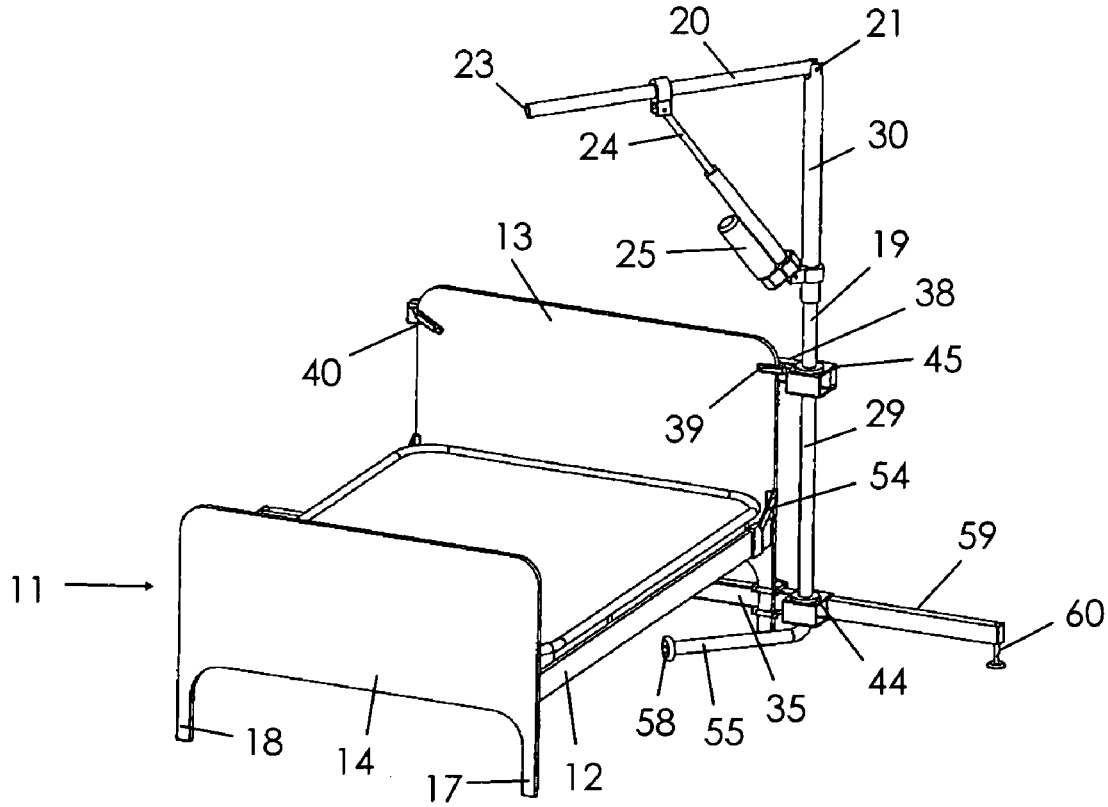
FIGS. 4*a* and 4*b* are perspective views illustrating the swinging movement of the boom and upright member from a first position over the bed, as shown in FIG. 4*a*, to a second position away from the bed, as shown in FIG. 4*b*.
Figure 4B:
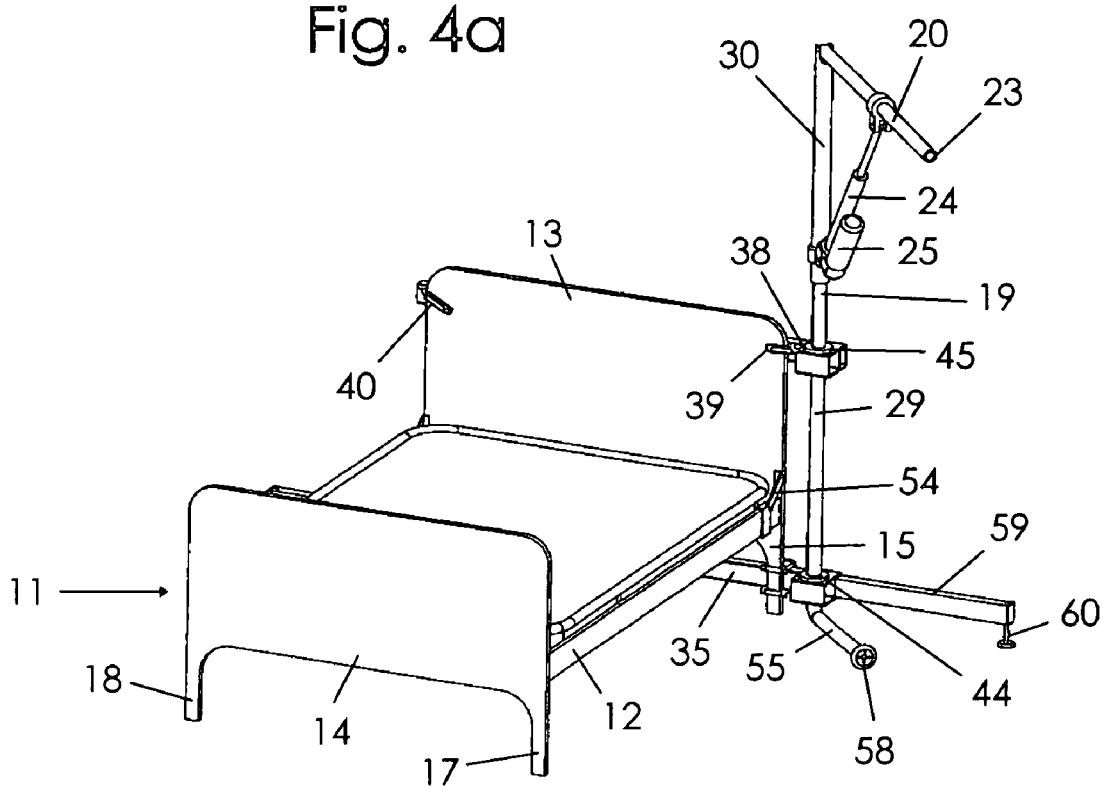
Figure 5A:
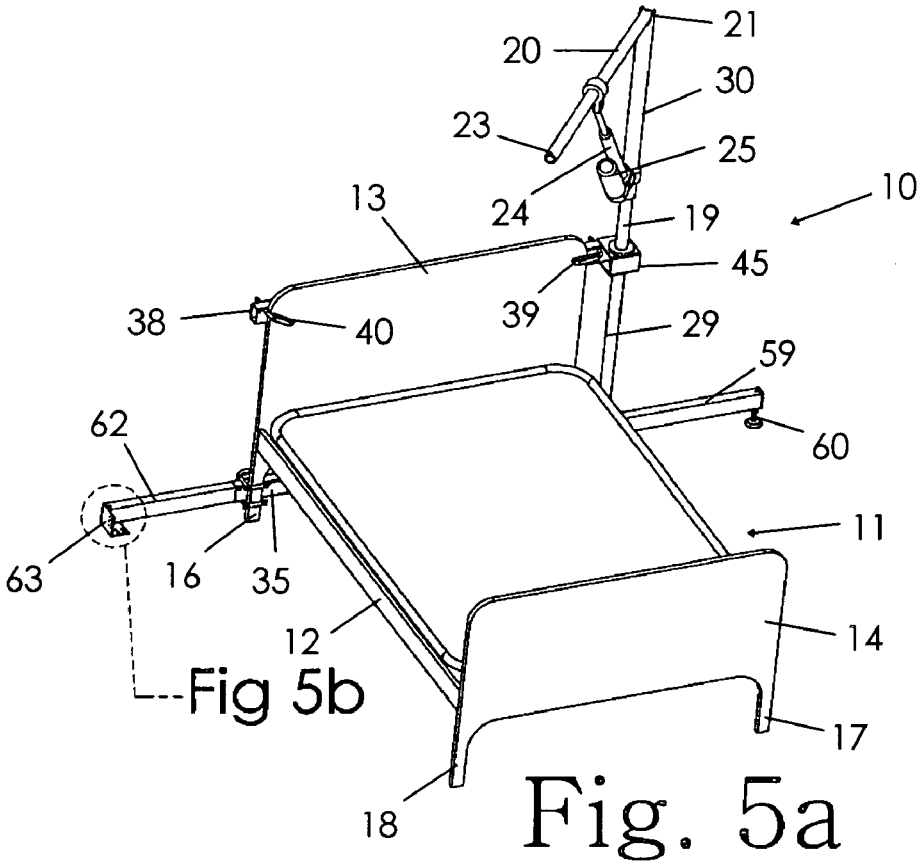
FIG. 5*a* is a perspective view of the patient lifting apparatus attached to a bed frame.
Figure 5B:
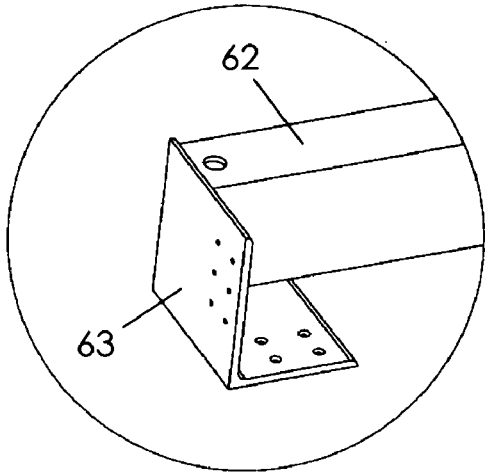
FIG. 5*b* is a perspective detail view of the portion indicated in FIG. 5*a* showing a first end of a support arm of the patient lifting apparatus.

Rather than, or in addition to, reinforcing the bed frame 11 to handle the additional torque, the preferred embodiment incorporates a support arm 55 mechanically associated with the upright member 19 that minimizes the torque and stress on the bed frame 11. The support arm 55 extends from the lower end 56 of the central column 29 of the upright member 19 and has a free end 57 placed as directly under the weight of the patient as is possible. The support arm 55 pivots with the upright member 19 and the boom 20 about a vertical axis between a first position with the end 23 of the boom 20 over the bed, as shown in FIG. 4*a*, and a second position with the end 23 of the boom 20 away from the bed, as shown in FIG. 4*b*. The free end 57 of the support arm 55 remains under the end 23 of the boom 20 (hence, the weight of the patient) at all times, and the twist transmitted to the bed frame 11 is thereby minimized.

A small wheel or caster 58 is provided at the end 57 of the support arm 55 to provide smooth travel over the floor. The support arm 55 can be used to transmit all of the vertical load from the weight of the lifted patient to the floor without passing through the bed frame 11, thus making a thrust bearing between the lower support bar 35 and the upright member 19 unnecessary (e.g., a radial ball bearing or bushing similar to the upper bearing 51 will suffice).

Figure 6A:
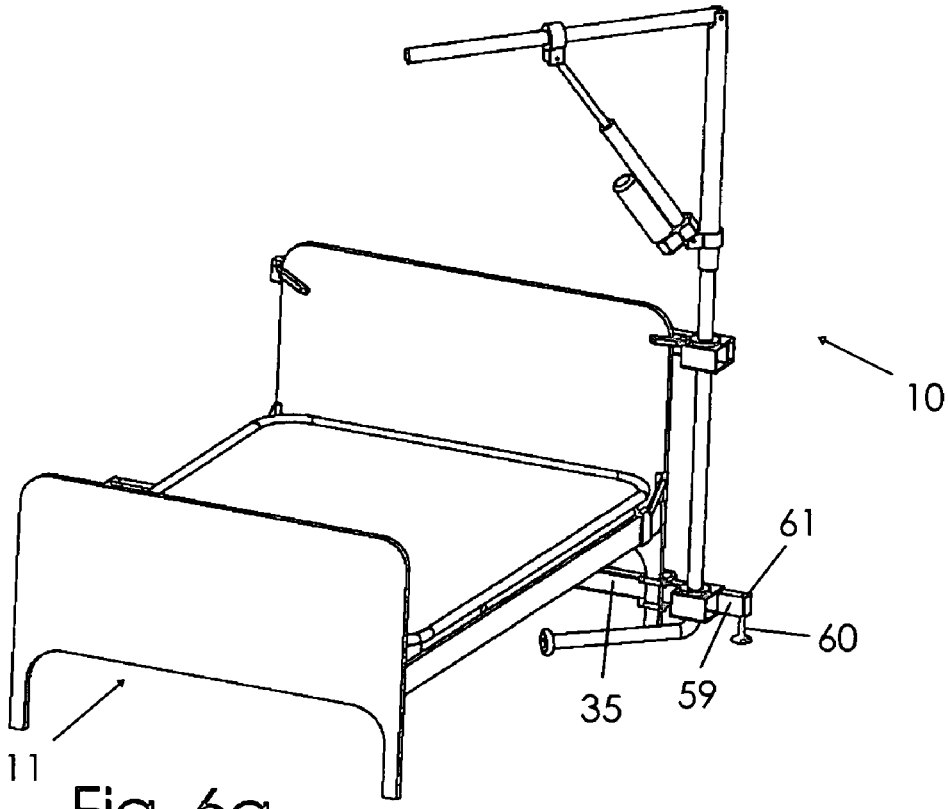
FIGS. 6*a* and 6*b* are perspective views illustrating the telescoping adjustment of a second end of the support arm from a retracted position, as shown in FIG. 6*a*, to an extended position, as shown in FIG. 6*b*.
Figure 6B:
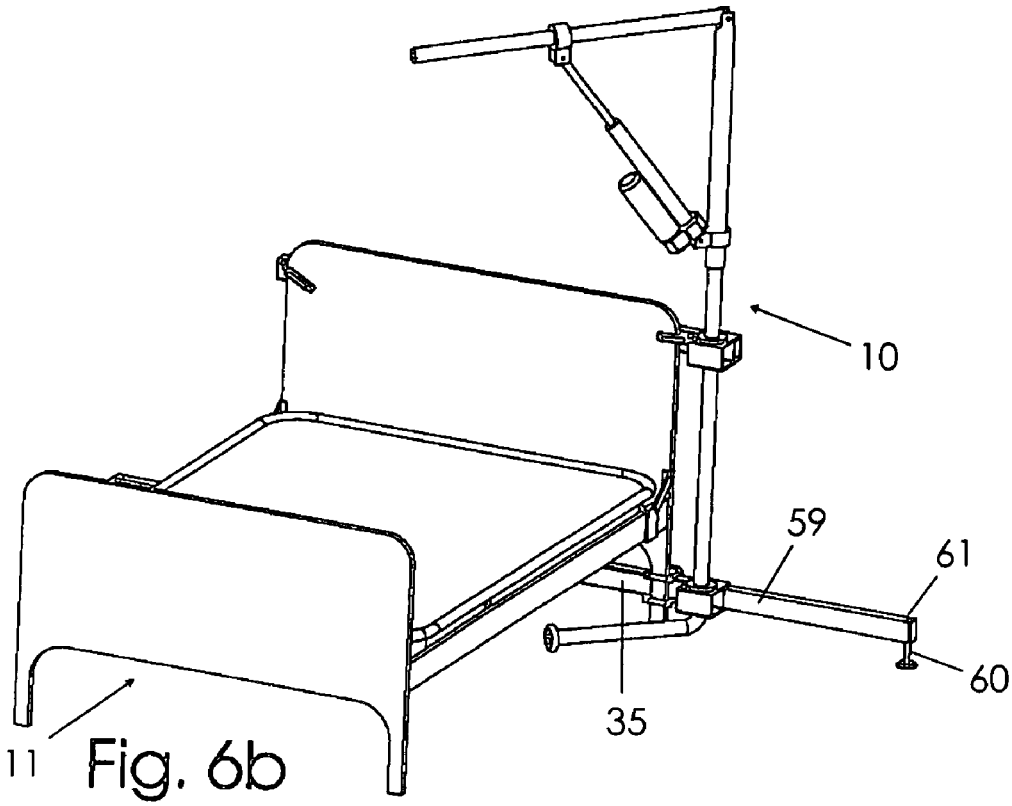

As the patient's weight is swung out away from the bed, the bed may be susceptible to tipping. This tendency is reduced by use of the support arm 55 described above, but may still be present to a lesser degree. A telescoping foot member 59 that extends from the lower support bar 35 solves this problem. The telescoping foot member 59 is movable between its stored position, as shown in FIG. 6*a*, and its extended position, as shown in FIG. 6*b*. An adjustable support pad 60 for contacting the floor is provided at the free end 61 of the telescoping foot member 59. The adjustable support pad 60 is coated with a soft, high friction material, such as molded rubber, to ensure a stable footing and to minimize scratching of the floor.

A second telescoping member 62 can be provided at the other end of the lower support bar 35 for further stabilizing the apparatus 10. The second telescoping member 62 can be provided with a plate weldment 63, as shown in detail in FIGS. 5*a* and 5*b*. The plate weldment 63 has a plurality of mounting holes formed therein for attaching directly to the floor, to an extra-wide bed frame, or to a wall or other available structure for supporting and stabilizing the apparatus 10.

Figure 7A:
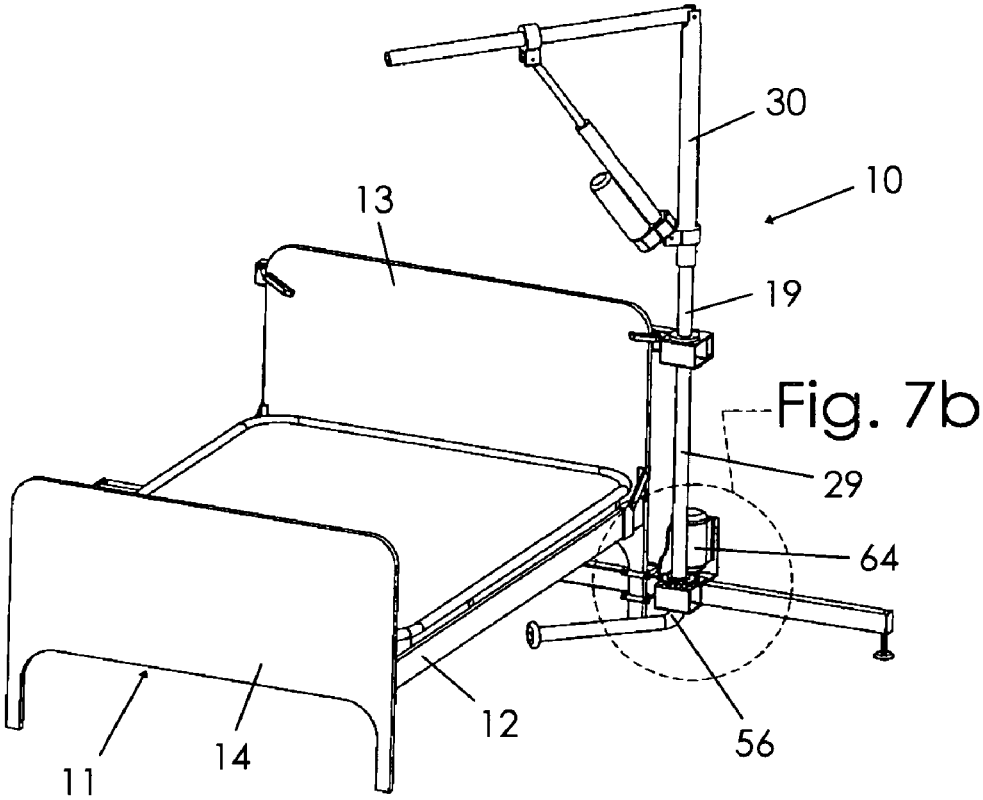
FIG. 7*a* is a perspective view of an alternative embodiment of the patient lifting apparatus of the present invention in which an actuator is provided for swinging the upright member about its longitudinal, upright axis.
Figure 7B:
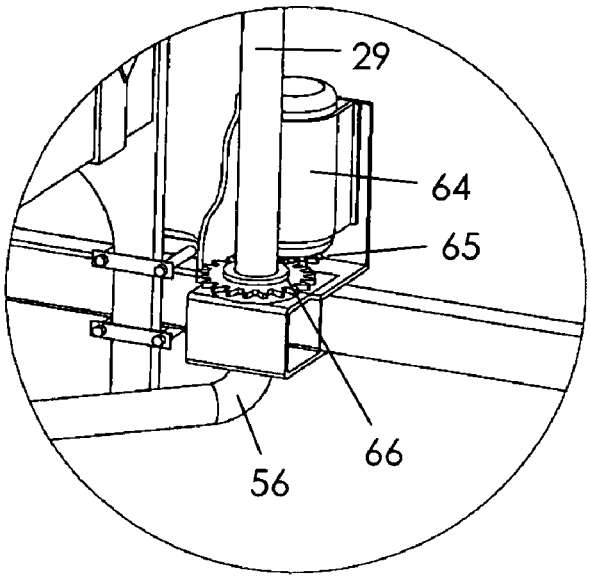
FIG. 7*b* is a perspective detail view of the portion indicated in FIG. 7*a* showing the actuator and associated drive mechanism used in the alternative embodiment of FIG. 7*a*.

Although operation of the patient lifting apparatus 10 requires very little force to rotate the patient once he or she is raised, it is desirable to have the ability to automatically rotate the upright member 19 and the boom 20 using the push of a button. To accomplish this, a gear motor 64 can be mounted to the lower support bar 35, as shown in FIGS. 7*a* and 7*b*. The gear motor 64 has a driving gear 65 engaged with a driven gear 66 near the lower end 56 of the central column 29. The gear motor 64 is connected to a power source (not shown), such as an electrical outlet, and can be conveniently controlled using a switch button on the hand held control 28.

The ability to automatically rotate the upright member 19 and the boom 20 provides a more complete level of independence to the final users of the apparatus 10. Also, having complete control over the lift and rotation of the apparatus 10 might help to calm the fears of some patients, and give more independence to others.

Figure 8A:
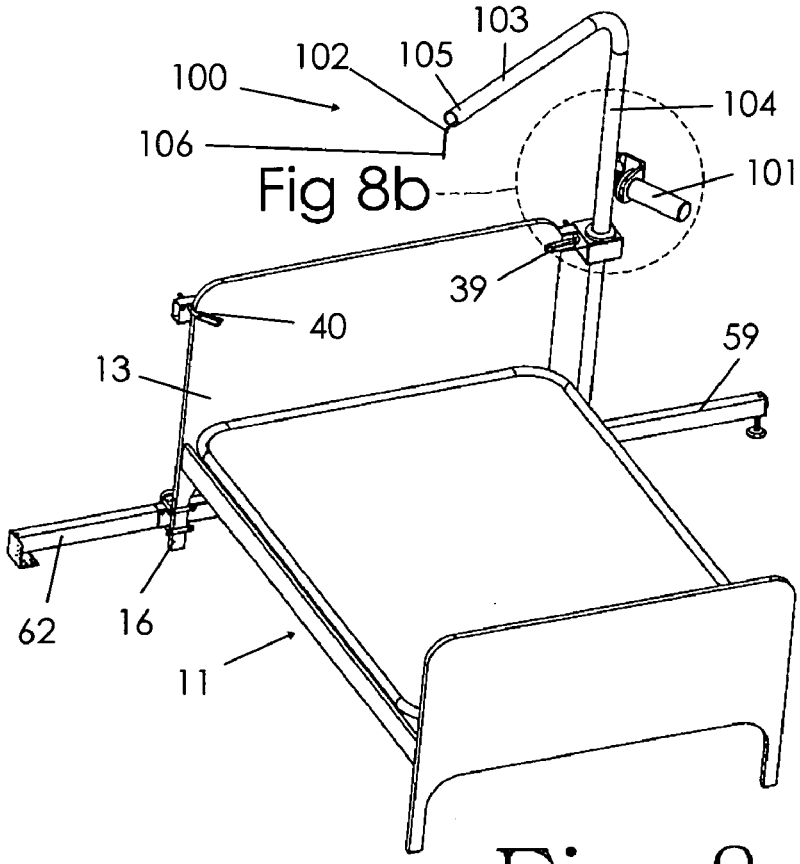
FIG. 8*a* is a perspective view of another alternative embodiment of the patient lifting apparatus in which a winch is used instead of a linear actuator to lift a patient.
Figure 8B:
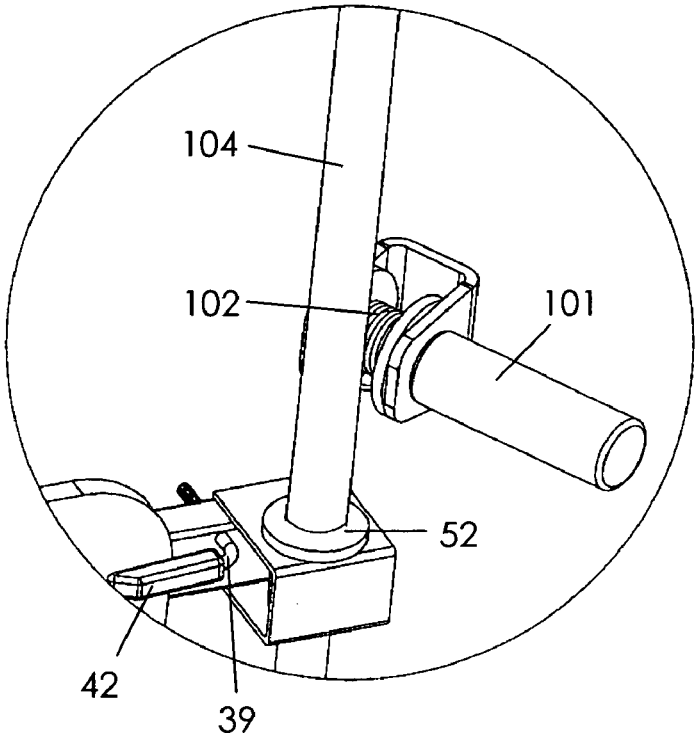
FIG. 8*b* is a perspective detail view of the portion indicated in FIG. 8*a* showing the winch and associated drive mechanism used in the alternative embodiment of FIG. 8*a*.

An alternative embodiment of the patient lifting apparatus 100 will now be described with reference to FIGS. 8*a* and 8*b*. In this embodiment, a winch 101 and cable 102 are used instead of a linear actuator to lift a patient. The boom 103 is integral with the upright member 104 in this embodiment and does not pivot relative thereto as in the embodiment described above. Instead, the tip 105 of the boom 103 remains at a constant height, and the cable 102 of the winch 101 raises and lowers as necessary to raise and lower the patient.

The winch 101 is mounted to the upright member 104, and the cable 102 extends from the winch 101 into a bent pipe or the like that serves as the upright member 104 and the boom 103. The end 106 of the cable 102 hangs from the tip 105 of the boom 103 and has a grapple, sling or other suitable structure (not shown) secured thereto for engaging a patient to be lifted. One or more pulleys (not shown) may be incorporated into this embodiment to minimize friction forces as the cable 102 is moved within the upright member 104 and the boom 103. Operation of this embodiment 100 is much the same as the embodiment 10 described above, with a hand held control (not shown) being used to selectively energize the motor of the winch 101 to raise and lower the patient.

The present invention provides a patient lifting apparatus 10, 100 that uses a common household fixture, i.e., a bed frame 11, for support. As a result, a cheaper, lighter, yet still robust patient lift is provided, making the lift apparatus suitable for both in-home care situations and small managed health care scenarios. The apparatus 10, 100 is flexible and adjustable to accommodate a wide variety of sizes and constructions of bed frames 11.

While the invention has been specifically described in connection with specific embodiments thereof, it is to be understood that this is by way of illustration and not of limitation, and the scope of the appended claims should be construed as broadly as the prior art will permit.

What is claimed is:

1. A patient lifting apparatus, comprising:

an upright member;

a boom mechanically associated with said upright member for conveying a patient from one location to another;

a support structure for attaching said upright member to a bed frame, said support structure being arranged to transfer torque from the lifting apparatus to the bed frame during operation, said support structure comprising a lower support bar that extends across the bed frame and has each of its ends fastened to a respective leg of the bed frame;

a telescoping foot member that extends from the lower support bar and is movable between a stored position and an extended position for stabilizing the apparatus during use; and wherein said support structure includes an upper support bar that extends across the bed frame and has each of its ends fastened to a respective side of the headboard of the bed frame.

2. The patient lifting apparatus according to claim 1, wherein said upper support bar comprises a pair of clamps positioned at respective ends thereof for engaging the respective sides of the headboard of the bed frame.

3. The patient lifting apparatus according to claim 1, wherein said support structure comprises an upper bearing that allows smooth rotation of the upright member relative to the bed frame, and a lower bearing that transfers the vertical force of a patient's weight into the bed frame.

4. In combination, a bed frame and a patient lifting apparatus, said bed frame comprising a plurality of legs and a headboard, said patient lifting apparatus comprising:

an upright member;

a boom mechanically associated with said upright member for conveying a patient from one location to another;

a support structure having an upper attachment system that secures the upright member to the headboard, and a lower attachment system that secures the upright member to at least one of the legs, said support structure being arranged to transfer torque from the lifting apparatus into the bed frame during operation; and wherein said upper attachment system of the support structure comprises an upper support bar that extends across the bed frame and has each of its ends fastened to a respective side of the headboard of the bed frame.

5. The patient lifting apparatus according to claim 4, wherein:

said lower attachment system of the support structure comprises a lower support bar that extends across the bed frame and has each of its ends fastened to a respective leg of the bed frame; and further comprising a telescoping foot member that extends from the lower support bar and is movable between a stored position and an extended position for stabilizing the apparatus during use.

6. The patient lifting apparatus according to claim 4, wherein said upper attachment system comprises an upper bearing that allows smooth rotation of the upright member relative to the bed frame, and said lower attachment system comprises a lower bearing that transfers the vertical force of a patient's weight into the bed frame.

7. The patient lifting apparatus according to claim 4, further comprising a support arm mechanically associated with the upright member that rotates along with the boom about a generally vertical axis and engages a floor on which the bed is supported to transfer the vertical force of a patient's weight into the floor via the support arm rather than via the bed frame.

* * * * *